United States Patent [19]

Shelor

[11] Patent Number: 4,928,635

[45] Date of Patent: May 29, 1990

[54] POWER PLANT AND METHOD OF RETROFITTING EXISTING POWER PLANTS

[76] Inventor: Mack Shelor, 14304 Longate Rd., Midlothian, Va. 23112

[21] Appl. No.: 383,064

[22] Filed: Jul. 20, 1989

[51] Int. Cl.[5] ..... F22D 1/00

[52] U.S. Cl. ..... 122/7 R; 122/1 R; 123/2

[58] Field of Search ..... 122/7 R, 7 D, 1 R, 4 R; 123/2, 3

[56] References Cited

U.S. PATENT DOCUMENTS

| | | | |
|---|---|---|---|
| 485,988 | 11/1892 | Seigneuret . | |
| 1,103,948 | 7/1914 | Dow . | |
| 1,436,078 | 11/1922 | Bell . | |
| 1,594,383 | 8/1926 | Ruths . | |
| 3,071,449 | 1/1963 | Shustack . | |
| 3,095,861 | 7/1963 | Norris | 122/7 R |
| 3,350,876 | 11/1967 | Johnson . | |
| 3,713,294 | 1/1973 | Balje et al. . | |
| 3,808,805 | 5/1974 | Miramontes . | |
| 3,884,194 | 5/1975 | Grosseau | 122/7 R |
| 4,049,972 | 9/1977 | Crowdy et al. . | |
| 4,201,058 | 5/1980 | Vaughan . | |
| 4,394,582 | 7/1983 | Kreissl et al. . | |
| 4,570,077 | 2/1986 | Lambley . | |
| 4,572,110 | 2/1986 | Haeflich | 122/7 R |

OTHER PUBLICATIONS

10 MW Dual-Fuel Heat and Power Station, Gunter Taubert, Diesel & Gas Turbine Worldwide, Oct., 1981, vol. XIII, No. 8.

*Primary Examiner*—Edward G. Favors

*Attorney, Agent, or Firm*—Cushman, Darby & Cushman

[57] ABSTRACT

A power plant including a coal-fired boiler, having a boiler space, heat exchanging means for generating steam, one or more air ports and exhaust means. The power plant also includes an internal combustion engine having an exhaust means, wherein the exhaust means of the engine are connected to the air ports of the boiler. A thermal $NO_x$ reduction system is disposed in the boiler for reducing the $NO_x$ content of both the internal combustion engine and boiler emissions. The engine further includes water cooling means, and heat is transferred from the engine to the heat exchanging means for generating steam. The exhaust means are connected to the boiler space either by secondary air ports adjacent or surrounding the coal nozzles of the boiler, by overfire air ports, by underfire air ports or by any combination of these ports. Means are preferably provided for removing $SO_2$ and particulate pollutants from the exhaust of the boiler.

11 Claims, 1 Drawing Sheet

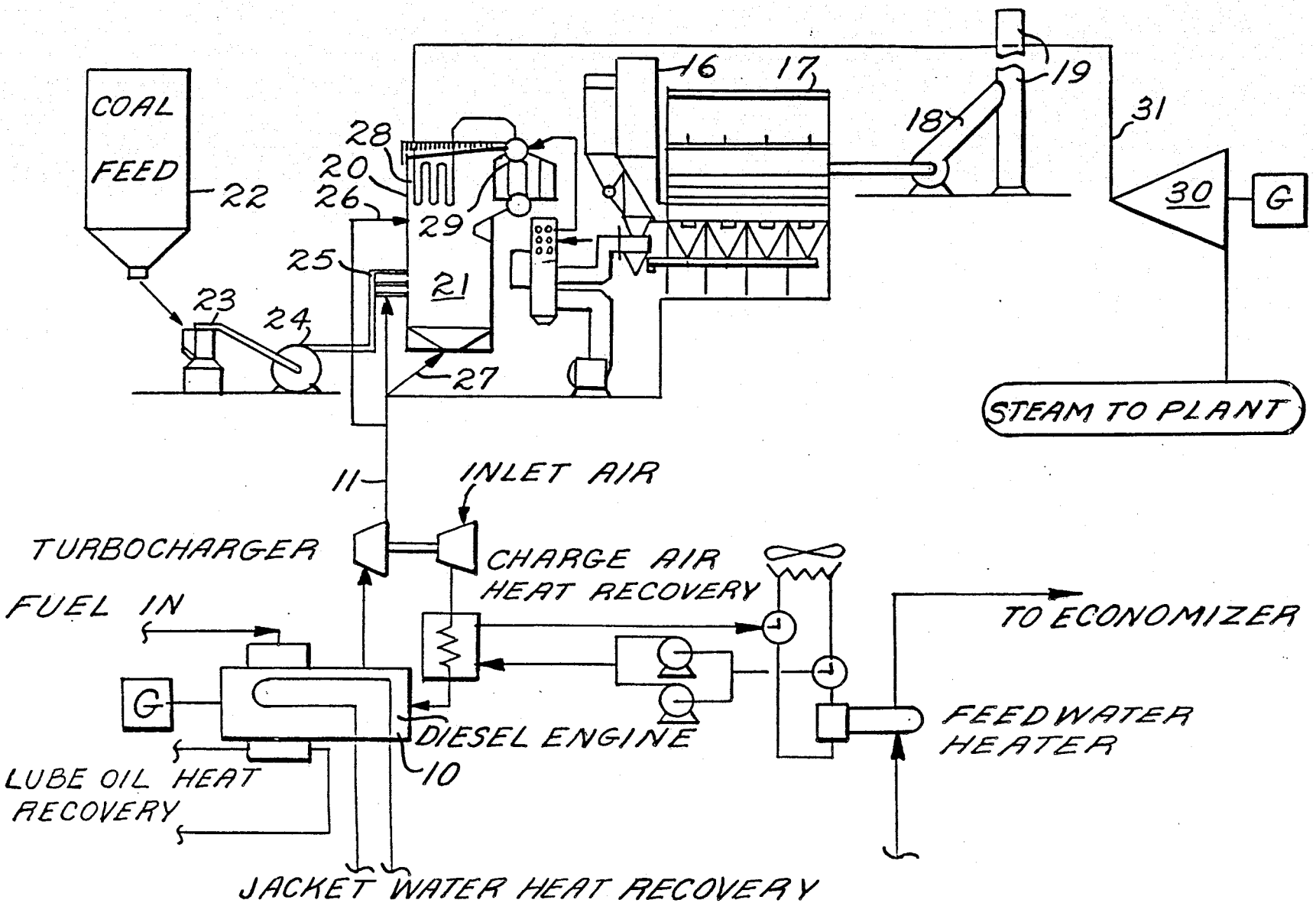
G
30
31
STEAM TO PLANT
19
18
17
16
TO ECONOMIZER
FEED WATER HEATER
CHARGE AIR HEAT RECOVERY
DIESEL ENGINE
INLET AIR
21
27
29
28
20
26
25
24
23
22
11
10
TURBOCHARGER
FUEL IN
LUBE OIL HEAT RECOVERY
JACKET WATER HEAT RECOVERY
COAL FEED

POWER PLANT AND METHOD OF RETROFITTING EXISTING POWER PLANTS

The present invention relates to a novel plant combining an internal combustion engine and a pulverized coal-fired boiler. More particularly, the present invention relates to a power plant in which the exhaust gases of the internal combustion engine are fed into the air ports of the coal-fired boiler so that the entire power plant has a single source of emissions.

Coal-fired power plants are common in the United States where coal is a plentiful, relatively inexpensive fossil fuel. However, coal is not a clean fuel. Significant capital expenditures must be made to incorporate the necessary emission control equipment into coal-fired power plants. Many coal-fired boilers presently utilize exhaust gas recirculation for control of nitrogen oxides ($NO_x$). These plants conventionally also have devices for removing $SO_2$ and particulate pollutants.

Internal combustion power plants are commonly used in countries where the primary source of fossil fuel is oil. Although oil is more expensive than coal on the whole, internal combustion engines are more efficient than coal-fired boilers. Internal combustion engines have the disadvantage that their exhaust gases contain high amounts of $NO_x$ which need to be removed before the exhaust gases are introduced into the atmosphere. The most efficient thermal de-$NO_x$ systems operate at temperatures exceeding the temperature of exhaust gases from internal combustion engines. Therefore, in order to remove $NO_x$ from these exhaust gases efficiently, the temperature of the gases must be raised, requiring a significant, additional input of energy.

It has long been recognized that the exhaust gases and waste heat of internal combustion engines present a potential source of unutilized energy, which could theoretically be tapped for the improvement of the efficiency of the power plant. However, few proposed uses for the exhaust gases have proved truly practical.

A method of utilizing the unburned hydrocarbons and carbon monoxide in the exhaust gases of an internal combustion engine to produce power for vehicle accessories is disclosed in U.S. Pat. No. 3,713,294. The patent discloses a method of reducing nitrogen oxides in the exhaust gases of an engine by (a) utilizing an excessively rich fuel-air mixture, and (b) further combusting the exhaust gases in a gas turbine engine.

A method of recirculating exhaust gases of internal combustion engines back into the engines for reducing the amount of waste gases produced is disclosed in U.S. Pat. No. 3,808,805. The method disclosed reduces the volume of the exhaust gases, thus improving the efficiency of catalytic converters, and reducing the concentration of harmful components by recycling the exhaust gases through the engine.

It is therefore an object of the present invention to provide a power plant with improved thermal efficiency over conventional coal-fired boilers.

It is also an object to provide a power plant with a single emission source so that the capital expense for emission control equipment is reduced.

It is an object of the present invention to provide a power plant capable of incorporating thermal and/or chemical methods of removing nitrogen oxides from the exhaust of the plant.

It is a further object of the present invention to provide a process for retrofiting coal-fired power plants with an internal combustion engine to improve the thermal efficiency of the plant.

It is an additional object of the present invention to provide a power plant with reduced total $CO_2$ production.

Yet another object of the present invention is to provide a steam-generating power plant with reduced water consumption.

A further object of the present invention is to provide a coal-fired power plant with reduced cost per unit of energy produced.

A still further object of the present invention is to provide a power plant with reduced capital cost in terms of cost per kilowatt.

Another object of the present invention is to provide a power plant with the capability to operate incrementally as a peaking and/or base load electric generating facility.

SUMMARY OF THE INVENTION

In accordance with the above objects there has been provided a power plant including a coal-fired boiler, having a boiler space, heat exchanging means for generating steam, one or more air ports and exhaust means. The power plant also includes an internal combustion engine having an exhaust means, wherein the exhaust means of the engine are connected to the air port of the boiler. A thermal $NO_x$ reduction system is disposed in the boiler for reducing the $NO_x$ content of both the internal combustion engine and boiler emissions.

Preferably, the engine further includes water cooling means, and heat is transferred from the engine to the heat exchanging means for generating steam. The exhaust means are connected to the boiler space either by secondary air ports adjacent or surrounding the coal nozzles of the boiler, by overfire air ports, by underfire air ports or by any combination of these ports. Means are preferably provided for removing $SO_2$ and particulate pollutants from the exhaust of the boiler.

BRIEF DESCRIPTION OF THE DRAWING

FIG. 1 shows a schematic diagram of an embodiment of the power plant according to the present invention.

DETAILED DESCRIPTION OF THE PREFERRED EMBODIMENT

An embodiment of the power plant of the present invention is shown in the FIG. 1.

The power plant according to the present invention comprises an internal combustion engine 10. Engine 10 can be a large diesel engine of the type conventionally employed to generate electrical power. The engine 10 has an exhaust 11 which is fed into a coal-fired boiler 20.

Boiler 20 is, in the preferred embodiment, a pulverized coal type coal-fired boiler. Coal is supplied from a coal source 22 to a pulverizer 23. The pulverized coal is mixed with primary air by primary air fan 24, and fed into the burners, or coal nozzles 25, and from there into the boiler space 21.

Exhaust gas from exhaust 11 of engine 10 is fed into the boiler space at three possible locations, or any combination of these locations. In the preferred embodiment, the exhaust 11 is fed as secondary combustion air in a wind box around the coal nozzles 25. The exhaust gas contains approximately 13% oxygen and is combined with preheated air to provide secondary air supply to the boiler. The exhaust gas is also fed into the boiler at overfire ports 26 above the secondary air to provide overfire air. Lastly, the exhaust gas is fed into the boiler space 21 at underfire ports 27 to provide underfire air. Preferably, the total flow of exhaust gas into boiler 20 is in the range 40–70% of the total gas flow into boiler 20.

Means are provided in the boiler space 21 for high temperature $NO_x$ reduction. According to the preferred embodiment, the system comprises adding urea, ammonia and/or chemical enhancers to reduce nitrogen oxides at temperatures between 1000° and 2100° F. The basic chemical reaction can be described as follows:

1. Urea +Nitrogen Oxides →Nitrogen +Carbon Dioxide +Water, or
2. Ammonia +Nitrogen Oxides →Nitrogen +Water The above chemical reactions can be caused to take place over a wide range of temperature by means of catalysts or enhancers. Reduction of $NO_x$ exceeding 70% can be achieved by this process.

Steam generated in the superheater 28 and convection section 29 of the boiler is conducted in line 31 to steam power generator 30. Sensible and low-grade heat from a water cooling system of the engine 10 are used for the various heat requirements of the steam generator 30 and boiler 20. For example, the waste heat from the engine could be used to preheat the air mixed with the exhaust gas fed into the secondary air port, to preheat fuel for engine 10 or to preheat water fed to the boiler 20. Waste heat from the engine may be heat from a turbocharger of engine 10, engine jacket water heat, or oil cooler heat. Of course, the sensible heat in the exhaust gas of the exhaust 11 is directly introduced into the boiler 20. The resulting improvement in fuel efficiency for electricity production is significant.

Carbon dioxide ($CO_2$) is a by-product of all fossil fuel combustion. As the system efficiency rises, the total amount of $CO_2$ evolved per unit of power produced is reduced. By combining the systemic efficiency associated with internal combustion engines with the total engine efficiency after the waste heat of the engine is utilized, the amount of $CO_2$ produced per unit of electricity is significantly reduced. The magnitude of this improvement will be obvious from the unit heat rate of the entire power plant.

Most coal-fired power plants consume large amounts of water as a result of the condensing required in the production of electricity. By utilizing the waste heat from the engine 10, the total water consumption per unit of electricity can be reduced. The amount of water conserved will depend upon the size of the engine 10 when compared with the size of the boiler 20. The water savings could be as high as 20% when compared with a conventional coal-fired power plant.

The combination of engine 10 and boiler 20 gives the overall plant the characteristics of both a base load electricity generating system and a peak electricity production system. The design of the power plant according to the present invention is made so that the engine can be operated either continuously, or in a peak load capacity as required. This aspect of the power plant is extremely important in planning for meeting expanding power plant needs.

The exhaust gases from the boiler 20, along with the recycled gases from engine 10 are lead into a wet or dry scrubber 16 for the removal of $SO_2$, and an ESP or baghouse 17 for the removal of particulate pollutants. The final emission passes through blower 18 to stack 19. According to the power plant of the present invention, coal and high sulphur residual oil can be utilized, and the levels of $NO_x$, $SO_2$ and particulates can be reduced to meet environmental standards.

The present invention also encompasses retrofitting existing coal-fired power plants to incorporate internal combustion engines. The method of the present invention, when incorporated in existing systems can increase output by 20 to 30% at very high thermal efficiency (over 75%), with only moderate additional cost and almost no increase in water consumption.

COMPARATIVE EXAMPLE

A comparison of a conventional P.C. boiler fired plant with a P.C. boiler and diesel engine plant according to the present invention is presented in Table 1. For this comparison, the steaming capacity (200,000 #/hr) and steam conditions (1500 psig/1000° F./3 inHgA) are the same for both plants.

The steam turbine generator output, at 26,082 KW is the same for both plants. In practice, less extraction steam is required for the plant according to the invention for regenerative feedwater heating due to the heat recovery from the diesel engine cooling water circuits. The combination of the present invention would therefore tend to increase the steam turbine generator output. However, reduction in regenerative steam requirements is offset to some extent by an increase in the steam demand from the $NO_x$ reduction system as steam is utilized as a carrier and atomizer of the $NO_x$ reduction chemical.

The diesel generator output of this comparison is determined primarily based upon the following considerations:

1. The increment of size must fit into the local utilities need for power; and
2. The maximum output is limited by the flue gas volume that can enter the pulverized coal boiler furnace. As the engine output is increased, the exhaust from the diesel engine will also increase until such time as the added expense of a larger pulverized coal boiler furnace is no longer economically viable.

For the comparative example, a 12 MW diesel engine is selected. Such an engine is about the largest diesel engine that can be economically utilized for the selected pulverized coal fired boiler size.

The fuel consumption and boiler efficiency of the conventional pulverized coal boiler plant are representative of a modern industrial size unit with economizer and air preheater surfaces. The reduced coal consumption in the combination plant is primarily due to the heat recovery from the diesel engine exhaust gases. As the engine exhaust gases are reduced in temperature from approximately 700° F. to the air heater outlet temperature of 350° F., sensible heat is released and thereby reduces the heat input required from the coal fuel source. The diesel engine requires 102 MMBtu/hr to produce 12,000 KW. With heat recovery, the engine heat rate is 5566 Btu/KWhr, or the efficiency is about 61%. Adding the diesel engine plant to the pulverized coal boiler plant results in a combination plant heat rate of 9750 Btu/KWhr. In comparison, the stand alone pulverized coal boiler plant heat rate is 11,664 Btu/KWhr, or the efficiency is about 29%. It is clear, then, that the overall heat rate of the pulverized coal boiler and diesel engine plant is significantly lower (16% lower than the pulverized coal boiler plant alone).

In addition to heat rate/efficiency improvement, the pulverized coal boiler and diesel engine combination also offer an improvement (>20%) on a capital cost, per KW, basis. The capital cost improvement is due, in large part, to the following:

1. Lower cost, on a KW basis, of the diesel engine.
2. Less ancillary support equipment/facilities, per KW, required by the diesel engine plant.
2. Combining the exhaust gases of the pulverized coal boiler and diesel engine, thereby eliminating duplication of costly pollution control equipment.

Finally, the water consumption for the combination pulverized coal boiler/diesel engine plant according to the present invention is 32% less than the conventional pulverized coal boiler plant. The majority of the make-up water is required for steam condensation. Because the diesel engine power output does not contribute any additional steam condensing load, the 12,000 KW of incremental power is added without the need for additional make-up water.

Although the present invention has been illustrated by means of a preferred embodiment, and a comparative example, one of skill in the art will recognize that departures may be made while remaining within the scope of the present invention. The scope of the present invention is solely determined by the appended claims.

TABLE I

Performance and cost comparison of a conventional pulverized coal fired plant with a pulverized coal fired boiler & diesel engine combination plant.

| | Conventional P.C. Boiler Plant | P.C. Boiler Diesel Engine Plant |
|---|---|---|
| I. Steam Conditions | | |
| Flow, lb/hr | 200,000 | 200,000 |
| Pressure, psig | 1500 | 1500 |
| Temperature, °F. | 1000 | 1000 |
| Exhaust Press, in HgA | 3 | 3 |
| II. Plant Output | | |
| Steam Turbine Generator, KW | 26,082 | 26,082 |
| Diesel Generator, KW | — | 12,000 |
| Total, KW | 26,082 | 38,082 |
| III. Fuel Consumption | | |
| Coal, MMBtu/hr | 273.8 | 258.2 |
| No. 6 Oil, MMBtu/hr | — | 102 |
| Total | 273.8 | 360.2 |
| IV. Heat Recovery | | |
| Engine Exhaust Gas & Engine Cooling Water, MMBtu/hr | — | 35.2 |
| V. Auxiliary Power Consumption | | |
| P. C. Boiler Plant, KW | 2,608 | 2,608 |
| Engine Plant, KW | — | 360 |
| Total | 2,608 | 2,968 |
| VI. Net Plant Heat Rate, BTU,Kwhr | 11,660 | 9,750 |
| Plant Efficiency, % | 29 | 35 |
| VII. Plant Cost | | |
| Capital, KS$, | 37,000 | 44,000 |
| $S/KW | 1,400 | 1,155 |
| VIII. Water Consumption | | |

TABLE I-continued

Performance and cost comparison of a conventional pulverized coal fired plant with a pulverized coal fired boiler & diesel engine combination plant.

| | Conventional P.C. Boiler Plant | P.C. Boiler Diesel Engine Plant |
|---|---|---|
| GPM | 290 | 290 |
| GPM/MW | 11.1 | 7.6 |
| % Diff. | 32% | |

What is claimed is:

1. A power plant comprising:

a. a coal-fired boiler, having a boiler space, heat exchanging means for generating steam, one or more air ports and exhaust means;

b. an internal combustion engine, having an exhaust means, wherein the exhaust means of the engine are connected to the air ports of the boiler;

c. a thermal $NO_x$ reduction system disposed in said boiler;

d. steam generation means operably connected to said boiler.

2. A method of retrofiting a coal-fired power plant having a boiler space, heat exchanging means for generating steam, an air port and exhaust means, comprising:

a. providing an internal combustion engine for generating power having an exhaust;

b. providing thermal means for reducing $NO_x$ in the boiler space;

c. connecting the exhaust of the internal combustion engine with the air port of the boiler.

3. A power plant according to claim 1, wherein said internal combustion engine further comprises water cooling means, and wherein waste heat from said water cooling means is introduced into said steam generation means.

4. A power plant according to claim 1, wherein said boiler is a pulverized coal boiler, and said air ports comprise primary air ports for providing primary air to said boiler space.

5. A power plant according to claim 1, said air ports comprise secondary air ports for providing secondary air to said boiler space.

6. A power plant according to claim 1, wherein said air ports comprise overfire ports for supplying overfire air to said boiler space.

7. A power plant according to claim 1, wherein said air ports comprise underfire ports for supplying underfire air to said boiler space.

8. A power plant according to claim 1, wherein said exhaust means for the boiler further comprises means for removing $SO_2$ from said emission.

9. A power plant according to claim 1, wherein said exhaust means for the boiler further comprises means for removing particulate pollutants.

10. A power plant according to claim 1, wherein said internal combustion engine further comprises water cooling means, and wherein the water cooling means are operably connected with said heat exchanging means so that heat from said water cooling means is transferred to said heat exchanging means.

11. A method according to claim 2, further comprising the steps of providing water cooling means for cooling said internal combustion engine, and transferring heat from the water cooling means to the heat exchanging means.

* * * * *